United States Patent [19]

Lopez et al.

[11] Patent Number: 4,762,812

[45] Date of Patent: Aug. 9, 1988

[54] HEAVY OIL HYDROPROCESS INCLUDING RECOVERY OF MOLYBDENUM CATALYST

[75] Inventors: Jaime Lopez, Benicia, Calif.; Eugene A. Pasek, Export; Anthony V. Cugini, Pittsburgh, both of Pa.

[73] Assignee: Chevron Research Company, San Francisco, Calif.

[21] Appl. No.: 767,821

[22] Filed: Aug. 21, 1985

Related U.S. Application Data

[63] Continuation-in-part of Ser. No. 527,414, Aug. 29, 1983, Pat. No. 4,557,821.

[51] Int. Cl.[4] ..... B01J 38/66

[52] U.S. Cl. ..... 502/26; 423/55; 423/56

[58] Field of Search ..... 502/26; 423/53, 55, 423/61, 56

[56] References Cited

U.S. PATENT DOCUMENTS

| | | | |
|---|---|---|---|
| 2,686,763 | 8/1954 | Johnson et al. | 502/26 |
| 3,220,956 | 11/1965 | Cramer et al. | 502/26 |
| 3,222,293 | 12/1965 | Erickson | 502/26 |
| 3,923,689 | 12/1975 | Broughton et al. | 423/461 X |
| 4,163,709 | 8/1979 | Burk et al. | 208/120 |
| 4,432,953 | 2/1984 | Hubred et al. | 423/140 |
| 4,434,140 | 2/1984 | Hubred et al. | 423/54 |
| 4,522,928 | 6/1985 | McVicker et al. | 502/26 |

*Primary Examiner*—Olik Chaudhuri

*Attorney, Agent, or Firm*—S. R. La Paglia; W. K. Turner; Q. Todd Dickinson

[57] ABSTRACT

A process for the recovery of a spent molybdenum catalyst from a hydroprocess for the upgrading of a nickel and vanadium containing hydrocarbonaceous mineral oil. The nickel and vanadium contaminated molybdenum catalyst is oxidized to convert the metals to oxides. Aqueous ammonia is added to preferentially dissolve molybdenum from nickel and vanadium. An amount of ammonia is used in excess of the amount required to produce an active catalyst for recycle and the excess ammonia is removed prior to recycle of the catalyst. The selectively of the separation of molybdenum from nickel and vanadium is improved by adding a reducing agent before or during the ammonia dissolving step. Hydrazine is a suitable reducing agent. The recovered molybdenum is sulfided and recycled.

24 Claims, 3 Drawing Sheets

HEAVY OIL HYDROPROCESS INCLUDING RECOVERY OF MOLYBDENUM CATALYST

Figure 1:
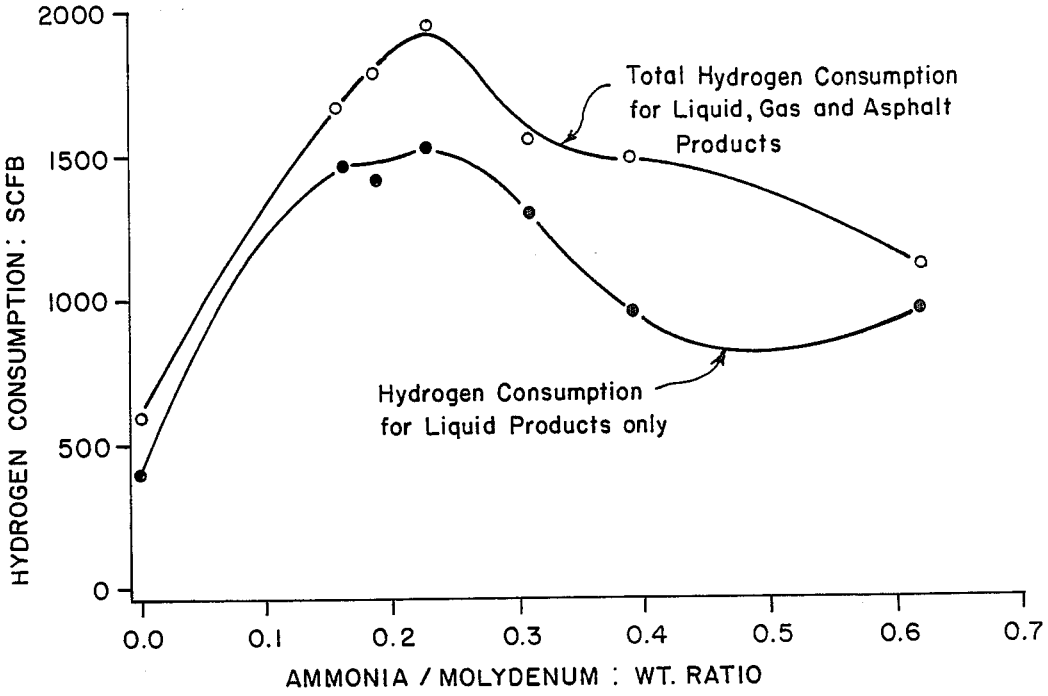

This application is a continuation-in-part of Ser. No. 527,414, filed Aug. 29, 1983, by J. Lopez, J. D. McKinney and E. A. Pasek, now U.S. Pat. No. 4,557,821.

This invention relates to a process for recovering a spent molybdenum catalyst used for the hydroprocessing of heavy hydrocarbonaceous oils including crude oils, heavy crude oils, residual oils, shale oils, oils from tar sands and coal liquids. Such feedstocks contain metal contaminants such as vanadium, nickel and iron. These metals accumulate on the catalyst and deactivate it. The present invention provides a method for the selective recovery of the molybdenum from the contaminant metals.

The method of this invention can be applied to the recovery of any molybdenum catalyst, regardless of its method of preparation. For example, the method can be applied to recovery of a fixed bed molybdenum-containing catalyst. However, the present invention is especially adapted to the recovery of an unsupported circulating sulfided molybdenum slurry catalyst, which can be a molybdenum disulfide catalyst. The catalyst recovery method of this invention employs ammonia for catalyst recovery and can be particularly adapted for use with the method of slurry catalyst preparation described below which employs ammonia and which is sensitive to the amount of ammonia employed in preparing the catalyst.

Particles of slurry catalyst which can be recovered by the method of this invention can exist as a substantially homogeneous dispersion in an oil or water/oil mixture of very small particles made up of extremely small crystallites. The activity of the catalyst is in significant part dependent upon the smallness of particle size because much of the activity probably is at the exterior of the catalyst. The catalyst is approximately molybdenum disulfide, which is probably structured molecularly as basal platelets of molybdenum atoms separated by two layers of sulfur atoms with activity sites concentrated at the edge of each basal plane of the molybdenum atoms. However, the ratio of sulfur to molybdenum is not necessarily two.

The slurry catalyst as described comprises dispersed particles of a highly active form of molybdenum sulfide. The first step in the preparation of this catalyst comprises formation of an oxygen containing soluble ammonium salt of molybdenum for sulfiding. Ammonium molybdates are suitable soluble salts. The ammonium molybdates are then sulfided with a sulfiding agent in a plurality of zones, stages or steps of increasing temperature. The sulfiding steps can include low, intermediate and high temperature sulfiding steps or can include low and high temperature sulfiding steps. Hydrogen sulfide, with or without hydrogen, is a suitable sulfiding agent. Each sulfiding step replaces a portion of the oxygen associated with the molybdenum with sulfur. The low and intermediate temperature sulfiding zones contain water and can be operated either in the presence of feed oil or in the substantial absence of feed oil. Feed oil is present in the high temperature sulfiding zone. If feed oil is not present in certain sulfiding zones ammonia can be conveniently separated from the stream leaving the last sulfiding zone in which no oil was present and before addition of feed oil.

The final catalyst can comprise crystallites of $MoS_2$, although the atomic ratio of sulfur to molybdenum frequently is not 2 or is only approximately 2. If the catalyst is $MoS_2$, it is an exceptionally active form of $MoS_2$. It appears that the activity of the final catalyst depends upon the conditions employed during its preparation. Application Ser. No. 527,414, filed Aug. 29, 1983, which is hereby incorporated by reference, taught the presence of feed oil during multistage sulfiding of the precursor ammonium salt to $MoS_2$ and did not teach ammonia removal during catalyst preparation. An improvement in catalyst activity can be achieved by performing a significant portion of the multistage sulfiding of the precursor ammonium salt in an aqueous phase in the substantial absence of any hydrocarbon oil phase and by separating ammonia from the system in advance of adding an oil phase.

The ammonium molybdates used can be prepared by dissolving a molybdenum compound, such as $MoO_3$, in aqueous ammonia to form ammonium molybdates, with or without the subsequent injection of hydrogen sulfide to the dissolving stage. The ammonium molybdates are soluble in the aqueous ammonia but the addition of hydrogen sulfide causes some dissolved molybdenum to separate as ammonium molybdenum oxysulfide solids.

Aqueous ammonium molybdenum oxysulfide from the dissolving stage can be mixed with all or a portion of the feed oil stream using the dispersal power of a hydrogen-hydrogen sulfide stream and the admixture can be passed through a plurality of sulfiding zones or steps of ascending temperatures. The sulfiding zones can be at least two or three in number, to provide a time-temperature sequence which is necessary to complete the preparation of the slurry catalyst prior to passing it to a higher temperature exothermic hydroprocesing reactor zone. Each sulfiding zone is operated at a temperature higher than its predecessor.

The residence time in each sulfiding zone or step can be, for example, 0.02 to 0.5 hours, or more. The various sulfiding zones or steps can employ the same or different residence times. For example, the high temperature sulfiding reactor can employ a residence time of 2 hours, or more. In general, the residence time in each sulfiding zone can be at least 0.02, 0.05, 0.1 or 0.2 hours. The residence time in each zone also can be at least 0.3, 0.4 or 0.5 hours. Each sulfiding zone is constituted by a time-temperature relationship and any single reactor can constitute one or more sulfiding zones depending upon whether the stream is heated or is at a constant temperature in the reactor and upon the duration of the stream time within a particular temperature range during stream residency in the reactor.

The first sulfiding stage is operated at a relatively low temperature with an aqueous phase and with or without feed oil. The second sulfiding stage can be operated at an intermediate temperature which is higher than the temperature of the low temperature sulfiding stage with an aqueous phase and either with or without feed oil. The total level of sulfiding achieved in the intermediate temperature stage (which total includes sulfiding performed in any prior stage) is important to catalyst activity, as explained above. The third sulfiding stage is a high temperature stage and is operated at a temperature which is higher than the temperature in the intermediate temperature stage. In a less preferred embodiment, the intermediate temperature sulfiding stage can be omitted.

The sulfiding reactions occurring in the low and intermediate temperature sulfiding stages generate ammonia from gradual decomposition of ammonium molybdate. If no oil is present, this ammonia, together with any excess ammonia present from the earlier reaction of ammonia with molybdenum oxide, can be flashed in a separator zone and separated from slurry-containing separator residue in advance of the high temperature sulfiding stage and prior to addition of oil. Thereupon, feed oil is added to the separator residue and the separator residue with feed oil is then passed to the high temperature sulfiding stage.

If the temperature in the high temperature sulfiding reactor is sufficiently high for hydroprocessing metals-containing hydrocarbon feed oil, the residence time in the high temperature reactor can be sufficient to accomplish both the high temperature sulfiding and the required hydroprocessing reactions. If a higher temperature is required to accomplish hydroprocessing of the feed oil, the effluent stream from the high temperature sulfiding reactor is passed to a hydroprocessing reactor operated at a hydroprocessing temperature which is higher than the temperature in the high temperature sulfiding reactor.

Although not to be bound by any theory, it is believed that the following reactions occur in the various catalyst preparation steps described above. In the first catalyst preparation step, insoluble, crystalline $MoO_3$ is mixed with water to form a non-oleaginous slurry which is reacted with ammonia to form soluble ammonium molybdates. As an example consider the following generalized equation for the formulation of ammonium heptamolybdate:

$$\underset{\substack{\text{Insoluble}\\\text{Crystalline}}}{7\,MoO_3} + 6\,NH_3 + 3\,H_2O \longrightarrow \underset{\text{Soluble}}{(NH_4)_6Mo_7O_{24}}$$

The $MoO_3$ is dissolved under the following conditions:

$NH_3$/Mo Weight Ratio: 0.1 to 0.6; preferably 0.15 to 0.3
Temperature, °F.: 33 to 350; preferably 120 to 180
Pressure: psig: 0 to 400; preferably 0 to 10.

The pressure and temperature are not critical. Increased pressure is required to maintain the ammonia in aqueous solution at elevated temperatures. Elevated temperature is necessary to insure reaction and vary the concentration of molybdenum dissolved in the solution.

The solution of ammonium molybdates is passed to a series of sulfiding reactors or steps operated at ascending temperatures. It is first passed to a relatively low temperature sulfiding reactor where it is contacted with gaseous hydrogen sulfide, preferably a hydrogen/hydrogen sulfide blend, with or without feed oil. The generalized sulfiding reaction is as follows:

$$(NH_4)_6Mo_7O_{24} + H_2S \longrightarrow \underset{\text{amorphous}}{(NH_4)_xMoO_ySz}$$

The above is a generalized equation when ammonium heptamolybdate is the starting material. The reaction products in the low temperature sulfiding reactor include ammonium molybdates, ammonium molybdenum oxysulfides and possibly molybdenum sulfides.

Following are the conditions in the low temperature sulfiding reactor:

SCF $H_2S$/lbs Mo Ratio: above 2.7; preferably above 12
Temperature, °F.: 70 to 350; preferably 130 to 180
Hydrogen sulfide: partial pressure, psi 3 to 400; preferably 150 to 250.

It is important not to exceed the above temperature range in the low temperature reactor. At temperatures above 350° F. ammonia loss from the catalyst precursor will occur faster than thiosubstitution can proceed and the resulting molybdenum compound will precipitate and possibly plug the reactor. It is possible to operate the low temperature reactor at a temperature below 325° or 350° F. for a relatively long duration to allow the thiosubstitution reaction to proceed faster than ammonia loss so that the molybdenum compound will not precipitate.

The effluent stream from the low temperature reactor can be passed to an intermediate temperature reactor, which may or may not contain oil, operated under the following conditions:

Temperature, °F.: 180 to 700; preferably 300 to 550
Hydrogen sulfide: Partial pressure, psi 3 to 440; preferably 150 to 250.

The temperature in the intermediate temperature reactor is higher than the temperature in the low temperature reactor. The time required will be sufficient to accomplish the level of sulfiding of the molybdenum compound required in that stage.

The following generalized reaction may occur in the intermediate temperature reactor:

$$(NH_4)_xMoO_ySz + H_2S \rightarrow MoO_{x'}S_{y'} + NH_3$$

where
x' is about 1
y' is about 2.

The molybdenum compound in the intermediate temperature reactor is sufficiently sulfided so that upon loss of ammonia it is in a particulate form which is sufficiently fine that it can remain dispersed with sufficient agitation. In addition, the molybdenum compound is sufficiently sulfided that a crystalline structure is evolving from the amorphous form it exhibited in the low temperature sulfiding temperature reactor.

In the effluent from the intermediate temperature reactor, the sulfur level in the precursor catalyst can advantageously represent a conversion to sulfur of between 50 and 95 percent or, most preferably, between 75 and 80 percent on a stoiciometric basis of the oxygen originally associated with the soluble ammonium molybdate. This conversion represents the total replacement of oxygen with sulfur in the ammonium molybdate precursor compounds occurring in the entire system through the intermediate temperature stage. The molybdenum compound leaving the intermediate temperature sulfiding stage requires further conversion of oxygen to sulfur to achieve the molybdenum sulfide active catalyst state. This further conversion occurs in the presence of oil in a high temperature sulfiding reactor, which is operated a temperature above the temperature of the intermediate temperature sulfiding reactor. The reaction occurring in the high temperature sulfiding reactor in the presence of an oil/water phase may be expressed by the following equation:

$$MoO_xS_y \xrightarrow{H_2/H_2S} \underset{\text{Highly Active}}{MoS_2} + H_2O$$

where x is about 1 y is about 2.

The high temperature sulfiding reactor is operated at a temperature in the range 500° to 750° F. and can also be employed as the hydroprocessing reactor if the feed oil is capable of being hydroprocessed at the temperature of the high temperature sulfiding reactor. However, feed oils commonly require hydroprocessing at temperatures above the temperature of the high temperature sulfiding reactor. In such case, a downstream hydroprocessing reactor is required. In general, the temperature in the hydroprocessing reactor is 650° to 950° F. and is above the temperature of the high temperature sulfiding reactor.

The total pressure in the sulfiding zones and the hydroprocessing reactor can be between 500 and 5,000 psi.

If the aqueous catalyst precursor leaving the intermediate temperature reactor were to be passed together with feed oil and hydrogen sulfide directly to a hydroprocessing reactor operated at a temperature above the temperature of the high temperature sulfiding reactor, such as 800° F., or above, the molybdenum compound would react with the water present to lose sulfur rather than gain it to form an inactive catalyst according to the following reaction:

$$MoO_xS_y + H_2O \xrightarrow{800°\ F.} \underset{\text{Inactive Catalyst}}{MoO_{x'}S_{y'}} + H_2S \text{ or}$$

$$(MoO_2/MoS_2 + H_2S)$$

where y' is less than 2. This material is not a sufficiently active catalyst to inhibit coking reactions. It is noted that the $MoO_xS_y$ (where x is about 1, y is about 2) in the presence of hydrogen sulfide and water reacts preferentially with the hydrogen sulfide to become sulfided at a temperature between 500° to 750° F. It has been found that the $MoS_2$ catalyst formed in the temperature range 500° to 750° F. is a low coking catalyst. However, at a temperature above this range, the $MoO_xS_y$ (where x is about 1 and y is about 2) in the presence of hydrogen sulfide and water reacts to form $MoO_{x'}S_{y'}$ (where y' is less than 2), which is inactive.

It will be appreciated that the low, intermediate and high temperature sulfiding zones, stages or steps described herein can constitute separate reactors, as illustrated, or some or all of these zones, stages or steps can be merged into a single reactor. In terms of concept, each of those sulfiding zones, stages or steps is represented by a residence time-temperature relationship. If the stream is heated through the temperature range heated above for any sulfiding zone, stage or step for the time indicated above, then the process requirements to satisfy that zone, stage or step has occurred.

The catalyst preparation method described above uses $MoO_3$ as a starting material for preparing the catalyst precursor. However, other molybdenum compounds are also useful. For example, thiosubstituted ammonium molybdates, such as ammonium oxythiomolybdate or ammonium thiomolybdate can be employed. Since these materials are produced from $MoO_3$ in the first two catalyst preparation steps described above, i.e. the reaction of $MoO_3$ with ammonia step and the low temperature sulfiding step, these two steps can be by-passed by employing these thiosubstituted compounds as starting materials. Therefore, when these thiosubstituted compounds are used as catalyst precursors a water slurry thereof can be injected with hydrogen sulfide and hydrogen and passed directly to the intermediate temperature sulfiding reactor described above, with the extent of conversion of oxygen to sulfur described above, followed by separation of ammonia and then the high temperature sulfiding reactor and the hydroprocessing reactor, as described above.

The slurry catalyst can be prepared by the methods described herein or by other methods. Whatever method is employed for slurry catalyst preparation, to complete the cycle for the process of slurry catalyst preparation and use, it is necessary to recover and recycle the catalyst. Following the hydroprocessing operation, an oil product can be recovered in atmospheric and vacuum distillation towers. The vacuum tower bottoms contains the catalyst with contaminant metals acquired from the feed oil. Some or all of the vacuum tower bottoms can be treated with a solvent to separate non-asphaltic oils from asphalt containing catalyst with metallic contaminants.

The deactivated catalyst slurry can comprise molybdenum sulfide catalyst contaminated with vanadium, nickel and some iron, derived from the oil being treated, all as sulfides. The catalyst-containing mixture is passed to a combustion zone to burn off coke and asphalt and to convert the metal sulfides to the corresponding metal oxides of their highest stable oxidation state. The oxidized spent catalyst is then passed to an aqueous ammonia dissolving zone to dissolve molybdenum in preference to the contaminating metals. Thereupon, to repeat the catalyst preparation procedure described above, the ammonia content of the dissolved ammoniacal molybdenum solution is adjusted by vaporization of excess ammonia and the resulting ammonium molybdate solution is then reacted with hydrogen sulfide in a plurality of sulfiding stages as described above to prepare a molybdenum sulfide catalyst for return to the oil hydrotreating process.

In the catalyst preparation procedure, a ratio of ammonia to molybdenum in the range of 0.1 to 0.6, generally, and 0.15 to 0.3, preferably, pounds of ammonia per pound of molybdenum can be employed for the conversion of molybdenum to ammonium molybdates in order to prepare a highly active catalyst. In accordance with the present invention, a much greater weight ratio of ammonia to molybdenum is employed in the catalyst recovery step than is required to prepare an active catalyst. Subsequently, the excess ammonia is removed to reduce the ratio of ammonia to molybdenum to the optimal level required for the production of a highly active catalyst.

Figure 2:
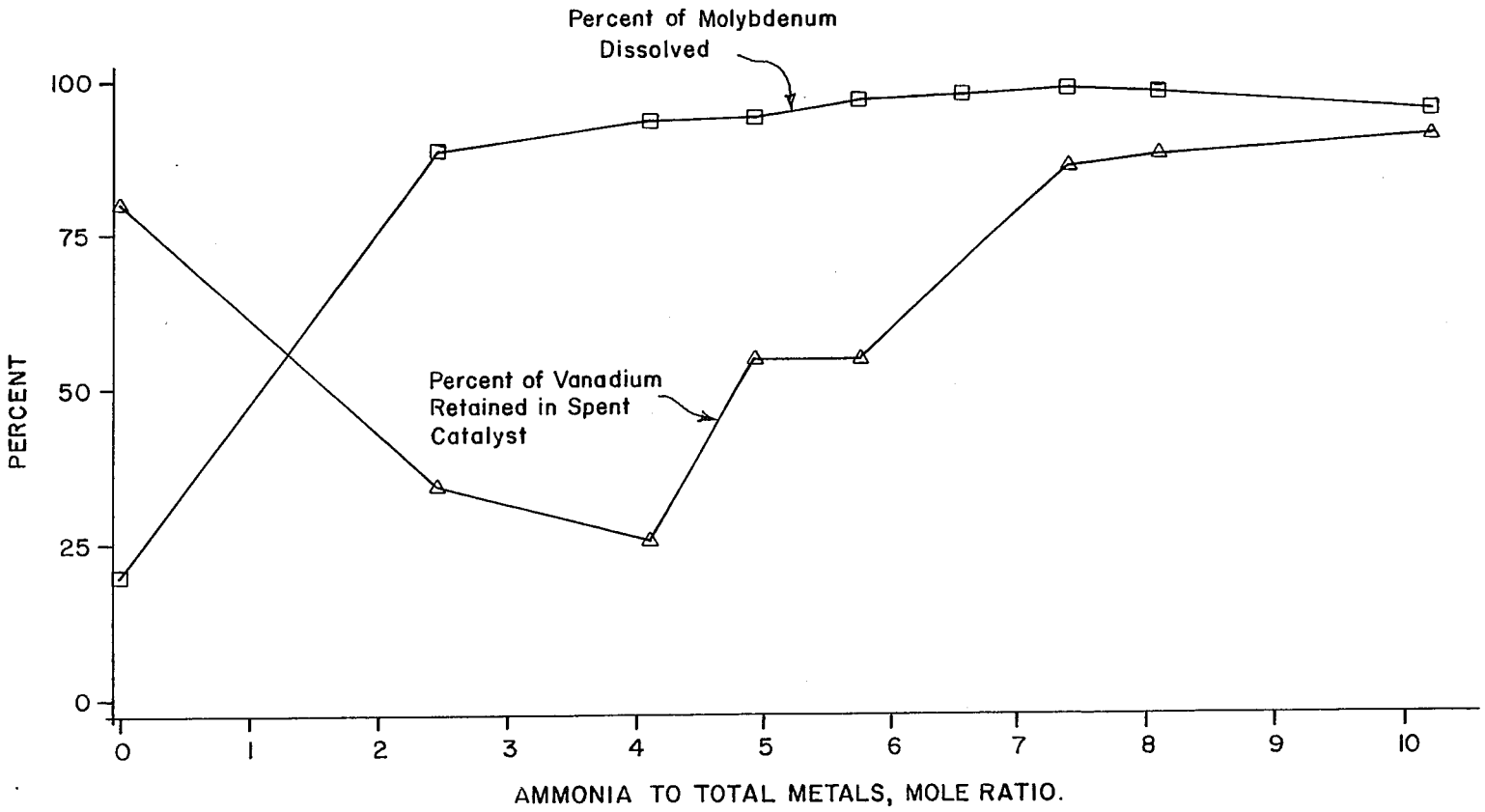
Figure 3:
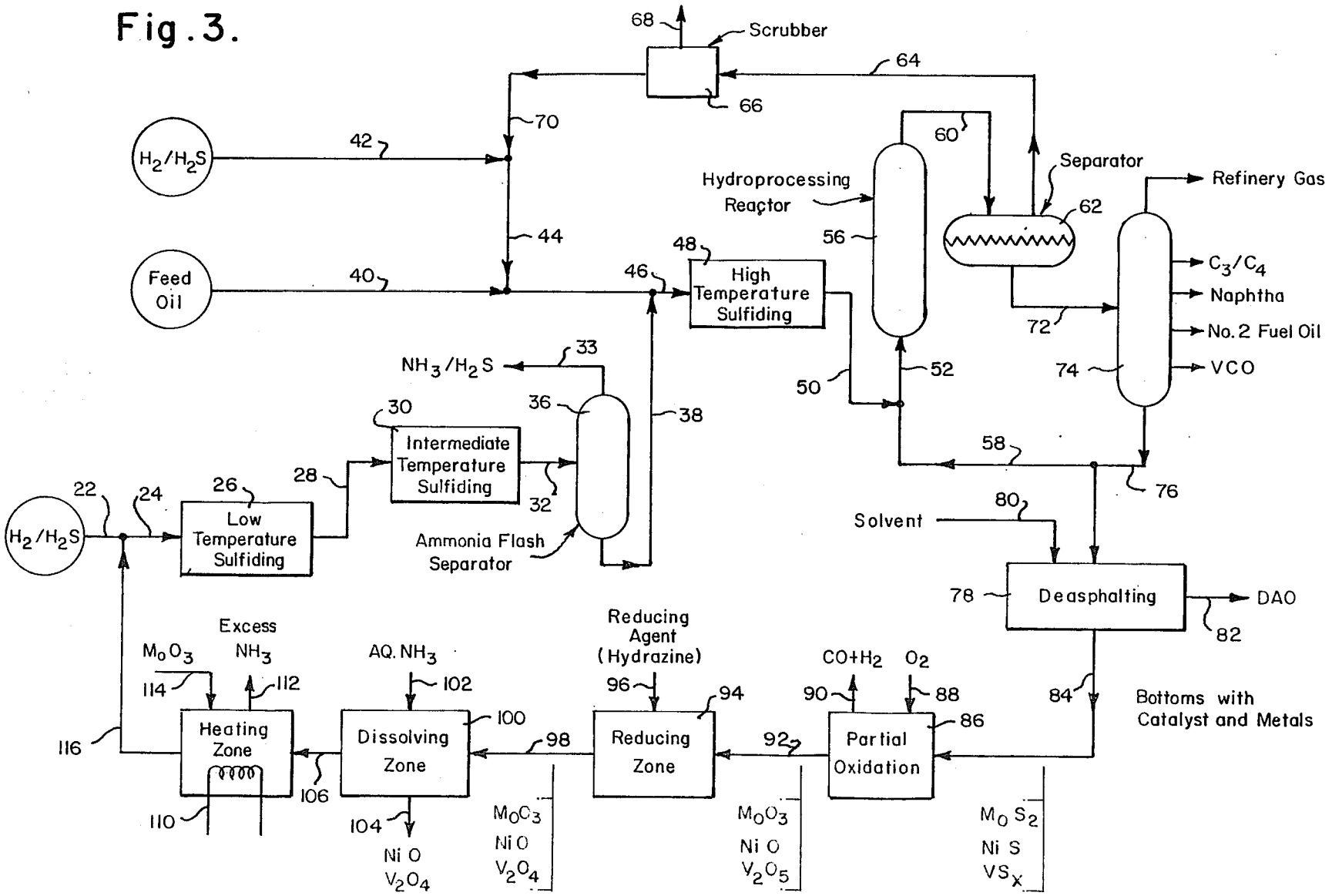

The present invention is illustrated by reference to the figures in which:

FIG. 1 relates the hydrogenation activity of a slurry catalyst prepared by the method described above to the weight ratio of ammonia to molybdenum used in preparing the catalyst;

FIG. 2 relates the amount of molybdenum recovered and the selectivity of vanadium separation to the mole ratio of ammonia to total metals in the catalyst recovery step; and FIG. 3 illustrates a combined process employing the method for catalyst preparation described above with the catalyst recovery method of this invention.

FIG. 1 is derived from Ser. No. 527,414 and shows the effect of the $NH_3$/Mo weight ratio used in preparing a molybdenum sulfide slurry catalyst upon the total hydrogen consumption for liquid, gas and asphalt products and for liquid product only in a hydroprocess using the resulting catalyst. FIG. 1 shows best catalyst activity is obtained with an $NH_3$/Mo weight ratio between 0.1 to 0.6, generally and 0.15 to 0.3, preferably.

FIG. 2 shows the results of test wherein molybdenum is preferentially dissolved from a spent vanadium-containing catalyst indicating that in general the molybdenum dissolution from and vanadium retention in the spent catalyst in the catalyst recovery operation are both high at relatively elevated levels of the mole ratio of ammonia used to total metals in the spent catalyst. FIG. 2 shows that the employment of a relatively high ammonia-to-metals mole ratio can achieve molybdenum recoveries from spent catalyst higher than 98 weight percent with more than 86 weight percent of the vanadium remaining in the spent catalyst. The amount of ammonia required for the best results shown in FIG. 2 is higher than the amount required for high catalyst activity in the catalyst preparation phase, as illustrated in FIG. 1.

FIG. 2 shows that molybdenum is very soluble in both relatively low and relatively high concentrations of ammonia. FIG. 2 also shows the unusual effect that vanadium is more soluble in low concentrations of ammonia than in high concentrations. Therefore, the metals recovery method of this invention utilizes a relatively high ratio of ammonia to metals in the catalyst recovery step. The method thereby utilizes the relatively high solubility in high concentrations of ammonia of molybdenum versus the relative insolubility in high concentrations of ammonia of vanadium. In accordance with this invention the mole ratio of ammonia to total metals in the spent catalyst in the catalyst recovery step is at least 2, generally, at least 5, preferably, and at least 7 or 7.5, most preferably. A suitable mole ratio range of ammonia to total metals in the spent catalyst is 7.5 to 9.

The molybdenum separation of the present invention can be improved by employing a reducing agent, such as hydrazine. Examples of other suitable reducing reagents include hydroxylamine and sulfur dioxide. The reducing treatment preferably precedes the extraction with aqueous ammonia. However, the reducing treatment can be coicident with the ammonia extraction step. The reducing treatment reduces the higher oxide of vanadium, $V_2O_5$, to a lower oxide, $V_2O_4$. The lower oxide which is formed is more easily separable from molybdenum in the ammonia extraction step.

The performance of the catalyst recovery process should be adapted to maximize molybdenum recovery while preferably at least 30 percent of the vanadium remains in the spent catalyst. Improving the vanadium selectivity so that amounts in excess of 90 percent of the vanadium remains in the spent catalyst will not have a significant effect upon the activity of the recycled catalyst. Therefore, the method of the present invention can advantageously retain in the spent catalyst after the ammonia dissolving step an amount up to 90 percent of the vanadium present in the spent catalyst reaching the dissolving step. Of course, it is not disadvantageous if more than 90 percent of the vanadium remains in the spent catalyst.

While the present method is adapted particularly for reclaiming molybdenum from spent slurry catalyst mixtures, it can also be employed for the recovery of molybdenum from a spent fixed bed of catalyst.

Tests have been performed for separating molybdenum from a spent catalyst containing it together with metal contaminants using hydrazine as a reducing agent. An aqueous slurry of metal oxides including $MoO_3$, NiO, $Fe_2O_3$ and $V_2O_5$ was treated with hydrazine ($H_2NNH_2$). The hydrazine reduced the vanadium from its maximum valence state (+5) to a lower valence state (+4). Aqueous ammonia (29 weight percent ammonia) was introduced so that the slurry had an ammonia concentration of about 7.5 molar. The slurries were heat treated in the 32° to 90° C. range during these extractions. The results of these treatments are presented in the following table.

| | WEIGHT PERCENT METALS IN SPENT CATALYST | WEIGHT PERCENT OF METALS EXTRACTED | | |
|---|---|---|---|---|
| | | AMMONIA WITHOUT HYDRAZINE | AMMONIA FOLLOWED BY HYDRAZINE | HYDRAZINE FOLLOWED BY AMMONIA |
| Molybdenum | 27.5 | 76.7 | 89.8 | 79.1 |
| Iron | 3.2 | 5.4 | 5.0 | 9.0 |
| Nickel | 6.5 | 8.8 | 42.9 | 17.7 |
| Vanadium | 13.0 | 45.0 | 9.0 | 5.0 |

The above data show that ammonia dissolution can extract molybdenum in relatively high yields (at least about 75 or about 90 weight percent) from spent/calcined slurry catalyst. The data show that without the use of a reducing agent a considerable amount of the vanadium present in the spent catalyst is also extracted with the molybdenum. In contrast, the use of a reducing agent, such as hydrazine, permits superior separation of molybdenum from vanadium. The data show that if it is desired to more effectively separate molybdenum from nickel it is beneficial to add the reducing agent first followed by the ammonia.

Returning again to FIG. 2, it is seen that while a high level of molybdenum is recovered at a mole ratio of ammonia to total metals in the spent catalyst of about 2.5, at a ratio of at least 6 or 7 the level of molybdenum recovery is slightly improved. However, at a ratio of ammonia to metals in the spent catalyst of about 2.5, the percentage of the vanadium that remains in the spent catalyst is relatively low. However, when the mole ratio increases to at least about 6 or 7 the percentage of vanadium that remains in the spent catalyst becomes relatively high. At a mole ratio of ammonia to metals above about 8 or 9, molybdenum recovery and vanadium selectivity are both very high.

These high ammonia ratios are significantly higher than are required in preparing highly active slurry catalysts. Therefore, the molybdenum recovery step is followed by separation or removal of undissolved spent catalyst from dissolved molybdenum solution. Thereupon, ammonia is removed from molybdenum-containing liquid to achieve a lower ratio of ammonia to molybdenum. The lower ratio of ammonia to molybdenum is conducive to the preparation of a highly active molybdenum sulfide slurry catalyst.

FIG. 3 illustrates a combined process for performing the present invention. As shown in FIG. 3, catalytic molybdenum, in the form of water-insoluble $MoO_3$, is introduced through line 114 to zone 108 containing aqueous ammonia. Recycle molybdenum together with aqueous ammonia, from a source described below, is introduced to zone 108 through line 106. Water insoluble molybdenum oxide is converted to a water soluble ammonium molybdate salt in zone 108.

Aqueous ammonium molybdate containing excess ammonia is discharged from zone 108 through line 116, admixed with hydrogen sulfide preferably incuding hydrogen entering through line 22 and then passed through line 24 to low temperature sulfiding zone 26. In low temperature sulfiding zone 26, ammonium molybdates are convered to thiosubstituted ammonium molybdates. In zone 26 the sulfiding temperature is sufficiently low that the ammonium salt is not decomposed while thiosubstitution is beginning. If the ammonium salt were decomposed in the early stages of thiosubstitution, an insoluble oxythiomolybdate or a mixture of $MoO_3/MoS_3$ would precipitate out in zone 26 and possibly plug zone 26.

An effluent stream from low temperature sulfiding zone 26 is passed through line 28 to intermediate temperature sulfiding zone 30. Intermediate temperature sulfiding zone 30 is operated at a temperature higher than the temperature in low temperature sulfiding zone 26. The sulfiding reaction is continued in zone 30 and ammonium oxythiomolybdate is converted to molybdenum oxysulfide, thereby freeing ammonia.

An effluent stream from intermediate temperature sulfiding zone 30 is passed through line 32 to ammonia separator or flash chamber 36. In flash separator 36, cooling and depressurizing of the effluent stream from line 32 causes vaporization of ammonia and hydrogen sulfide. Flash conditions are established so that only a minor amount of water is vaporized and sufficient water remains in the flash residue to maintain an easily pumpable slurry suspension of the catalyst.

Flash separator residue is removed from flash separator 36 through line 38. The flash residue in line 38 is essentially free of oil since no oil was introduced to low temperature sulfiding zone 26 or intermediate temperature sulfiding zone 30. Feed oil is introduced to the system for the first time through line 40 and is admixed with a hydrogen-hydrogen sulfide mixture entering through lines 42 and 44. The flash residue in line 38 together with feed oil, hydrogen and hydrogen sulfide is introduced through lines 46 to high temperature sulfiding zone 48.

High temperature sulfiding zone 48 is operated at a temperature higher than the temperature in intermediate temperature sulfiding zone 30. In high temperature sulfiding zone 48, molybdenum oxysulfide is converted to highly active molybdenum disulfide. The preparation of the catalyst is now complete. Some hydroprocessing of the feed oil entering through line 40 is performed in high temperature sulfiding zone 48.

An effluent stream from high temperature sulfiding zone 48 is passed through lines 50 and 52 to hydroprocessing reactor 56. Hydroprocessing reactor 56 is operated at a temperature higher than the temperature in high temperature sulfiding zone 48. If the slurry catalyst bypassed high temperature reactor 48 enroute to hydroprocessing reactor 56, the high temperature of hydroprocessing reactor 56 would cause the water in hydroprocessing reactor 56 to oxygenate the catalyst and therefore compete with sulfiding thereby causing the catalyst to be converted into a sulfur-deficient high coke producer. When high temperature sulfiding zone 48 precedes the hydroprocessing reactor, the relatively lower temperature in zone 48 allows the sulfiding reaction to prevail over any competing oxidation reaction in the presence of water to complete the sulfiding of the catalyst and render it stable at the higher temperature of hydroprocessing zone 56. With certain oil feedstocks, the relatively lower temperature of high temperature sulfiding zone 48 will suffice for performing the oil hydroprocessing reactions, in which case hydroprocessing reactor 56 can be dispensed with. However, most feed oils will require the relatively higher temperature in hydroprocessing reactor 56 to complete the oil hydrotreating reactions.

An effluent stream is removed from hydroprocessing reactor 56 through line 60 and passed to flash separator 62. An overhead gaseous stream is removed overhead from separator 62 through line 64 and is passed through a scrubber 66 wherein impurities such as ammonia and light hydrocarbons are removed and discharged from the system through line 68. A stream of purified hydrogen and hydrogen sulfide is recycled through lines 70, 44 and 46 to high temperature sulfiding reactor 48.

A bottoms oil is removed from separator 62 through line 72 and passed to atmospheric distillation tower 74. Various fractions are separated in tower 74 including a refinery gas stream, a $C_3/C_4$ light hydrocarbon stream, a naphtha stream, a No. 2 fuel oil and a vacuum charge oil stream for passage to a vacuum distillation tower, not shown.

A concentrated catalyst slurry stream is removed from the bottom of tower 74 through line 76. Some of this catalyst-containing stream can be recycled to hydroprocessing reactor 56 through line 58, if desired. Most, or all, of the heavy catalytic slurry in line 76 is passed to deasphalting chamber 78 to which a solvent is added through line 80 and from which a deasphalted oil is removed through line 82. A highly concentrated deactivated catalyst stream is removed from deasphalting chamber 78 through line 84 and passed to catalyst partial oxidation zone 86.

The catalyst entering partial oxidation zone 86 comprises molybdenum sulfide together with impurity metals acquired from the feed oil. The impurity metals comprise primarily vanadium sulfide and nickel sulfide. Oxygen as air is admitted to partial oxidation chamber 86 through line 88 and coke and asphaltenes are burned to a mixture of carbon monoxide and hydrogen, which can be used as low BTU fuel in the hydroprocess upon removal through line 90. At the same time, all of the metal sulfides are oxidized by combustion to the oxide state, including $MoO_3$, NiO and $V_2O_5$. These metal oxides are passed through line 92 to reducing zone 94. A reducing agent, such as hydrazine, is admitted to reducing zone 94 through line 96 and $V_2O_5$ is reduced to $V_2O_4$. The mixture of reduced metal oxides is then passed through line 98 to ammonia dissolving zone 100. Aqueous ammonia is charged to dissolving zone 100 through line 102 to dissolve molybdenum as ammonium molybdates leaving undissolved nickel oxide and vanadium oxide, which are removed through line 104.

Aqueous ammonium molybdate solution is removed from dissolving zone 100 through line 106 and passed to heating zone 108. Heat is supplied to heating zone 108 through coil 110 to drive off excess ammonia through line 112. Make-up molybdenum is added as aqueous $MoO_3$ slurry through line 114. The $MoO_3$ is dissolved in zone 108 and ammonium molybdates are passed to the catalyst sulfiding zones through line 116 to repeat the process cycle.

We claim:

1. A method for the recovery of spent catalyst from a hydroprocess for treating vanadium-containing hydrocarbon oil, said spent catalyst comprising molybdenum sulfide which is contaminated with vanadium sulfide accumulated from said hydrocarbon oil, said method comprising passing said vanadium contaminated molybdenum sulfide catalyst through an oxidizing zone to convert said molybdenum sulfide and said vanadium sulfide to oxides, passing said oxides and aqueous ammonia to a dissolving zone to preferentially dissolve molybdenum from vanadium, removing undissolved vanadium from said dissolving zone, and removing an aqueous stream comprising dissolved molybdenum and ammonia from said dissolving zone, wherein the mole ratio of ammonia to total metals in said spent catalyst in said dissolving zone is at least 2.5.

2. The method of claim 1 including the additional step of removing ammonia from said aqueous stream to reduce the ratio of ammonia to molybdenum in said aqueous stream and passing said aqueous stream containing dissolved molybdenum following ammonia removal to a sulfiding step to sulfide said molybdenum for recycle to said hydroprocess.

3. The method of claim 1 wherein the mole ratio of ammonia to total metals in said spent catalyst in said dissolving zone is at least 6.0.

4. The method of claim 2 wherein the weight ratio of ammonia to molybdenum in said aqueous stream following said ammonia removal step is between 0.1 and 0.6.

5. The method of claim 2 wherein the weight ratio of ammonia to molybdenum in said aqueous stream following said ammonia removal step is between 0.15 and 0.3.

6. The method of claim 1 wherein at least 75 weight percent of the molybdenum in said spent catalyst is dissolved.

7. The method of claim 1 wherein at least 90 weight percent of the molybdenum in said spent catalyst is dissolved.

8. The method of claim 1 wherein at least 30 weight percent of the vanadium in the spent catalyst remains undissolved in said dissolving zone.

9. The method of claim 1 wherein an amount up to 90 weight percent of the vanadium in the spent catalyst remains undissolved in said dissolving zone.

10. The method of claim 1 wherein more than 98 weight percent of the molybdenum in said spent catalyst is dissolved in said dissolving zone and more than 86 weight percent of the vanadium in the spent catalyst remains undissolved in said dissolving zone.

11. The method of claim 1 wherein said spent catalyst is a slurry catalyst.

12. The method of claim 1 wherein said spent catalyst is a fixed bed catalyst.

13. The method of claim 1 including a step wherein vanadium oxide formed in said oxidizing zone is reduced to a lower valence state.

14. The method of claim 13 wherein said valence reducing step is performed in said dissolving zone.

15. The method of claim 13 wherein said valence reducing step is performed in advance of said dissolving zone.

16. The method of claim 13 wherein hydrazine is employed as a valence reducing agent.

17. A method for the recovery of a spent catalyst from a hydroprocess for treating nickel and vanadium-containing hydrocarbon oil, said spent catalyst comprising a slurry molybdenum sulfide which is contaminated with nickel and vanadium accumulated from said hydrocarbon oil, said method comprising passing said spent catalyst through an oxidizing zone to convert said molybdenum and said nickel and vanadium to oxides including a relatively high valence state oxide of vanadium, adding a reducing agent to reduce the relatively high valence state oxide of vanadium to a lower valence stage oxide of vanadium and adding aqueous ammonia to preferentially dissolve molybdenum as compared to nickel and vanadium in a dissolving zone removing undissolved nickel and vanadium from the dissolving zone and removing an effluent aqueous stream comprising dissolved molybdenum and ammonia from said dissolving zone, wherein the mole ratio of ammonia to total metals in said spent catalyst in said dissolving zone is at least 2.5.

18. The method of claim 17 including the additional step of removing ammonia from said aqueous effluent stream and passing said aqueous effluent stream following ammonia removal to a sulfiding zone to sulfide said molybdenum for recycle to said hydroprocess.

19. The method of claim 17 wherein said reducing agent is added in advance of said ammonia addition step.

20. The method of claim 17 wherein said reducing agent is added coincidently with said ammonia addition step.

21. A method for the recovery of a spent catalyst from a hydroprocess for treating nickel and vanadium-containing hydrocarbon oil, said spent catalyst comprising molybdenum sulfide which is contaminated with nickel and vanadium accumulated from said hydrocarbon oil, said method comprising passing spent nickel and vanadium containing catalyst through an oxidizing zone to convert said nickel, vanadium and molbydenum to oxides including a relatively high valence state oxide of vanadium, adding a reducing agent to reduce the relatively high valence state oxide of vanadium to a lower valence state oxide of vanadium, then passing said oxides and aqueous ammonia to a dissolving zone to preferentially dissolve molybdenum from nickel and vanadium, removing undissolved nickel and vanadium from said dissolving zone, removing an effluent aqueous stream comprising dissolved molybdenum and ammonia from said dissolving zone, removing ammonia from said effluent aqueous stream to reduce the weight ratio of ammonia to molybdenum in said effluent aqueous stream, and passing said effluent aqueous stream following ammonia removal to a sulfiding zone to sulfide said molybdenum from recycle to said hydroprocess, wherein the mole ratio of ammonia to total metals in said spent catalyst in said dissolving zone is at least 2.5.

22. The method of claim 21 wherein said reducing agent is hydrazine.

23. The method of claim 21 wherein said reducing agent is hydroxylamine.

24. The method of claim 21 wherein said reducing agent is sulfur dioxide.

* * * * *

UNITED STATES PATENT AND TRADEMARK OFFICE

CERTIFICATE OF CORRECTION

PATENT NO. : 4,762,812

DATED : August 9, 1988

INVENTOR(S) : Jaime Lopez et al

It is certified that error appears in the above-identified patent and that said Letters Patent are hereby corrected as shown below:

Claim 17, Col. 12, line 19, "stage oxide of vanadium" should read --state oxide of vanadium--

Claim 21, Col. 12, line 59, "molybdenum from recycle" should read -- molybdenum for recycle--

Signed and Sealed this

Twenty-fourth Day of January, 1989

*Attest:*

DONALD J. QUIGG

*Attesting Officer*

*Commissioner of Patents and Trademarks*